US011264696B2

(12) United States Patent
Shao et al.

(10) Patent No.: US 11,264,696 B2
(45) Date of Patent: Mar. 1, 2022

(54) MULTI-ANTENNA MOUNTING DEVICE AND MULTI-ANTENNA ASSEMBLY

(71) Applicant: CommScope Technologies LLC, Hickory, NC (US)

(72) Inventors: Shuguang Shao, Jiangsu (CN); Puliang Tang, Jiangsu (CN); Nengbin Liu, Jiangsu (CN); Xiaotuo Wang, Jiangsu (CN)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 17/089,375

(22) Filed: Nov. 4, 2020

(65) Prior Publication Data

US 2021/0194109 A1 Jun. 24, 2021

(30) Foreign Application Priority Data

Dec. 18, 2019 (CN) ..... 201922288763.1

(51) Int. Cl.

| | |
|---|---|
| ***H01Q 1/12*** | (2006.01) |
| ***H01Q 3/08*** | (2006.01) |
| ***H01Q 1/24*** | (2006.01) |

(52) U.S. Cl.

CPC ..... *H01Q 1/1264* (2013.01); *H01Q 1/1228* (2013.01); *H01Q 1/1242* (2013.01); *H01Q 3/08* (2013.01); *H01Q 1/246* (2013.01)

(58) Field of Classification Search

CPC .... H01Q 1/1228; H01Q 1/1264; H01Q 1/125; H01Q 1/1242; H01Q 1/246; H01Q 3/04; H01Q 3/06; H01Q 3/08

See application file for complete search history.

(56) References Cited

U.S. PATENT DOCUMENTS

| | | | | |
|---|---|---|---|---|
| 2015/0263424 | A1* | 9/2015 | Sanford | H01Q 13/206 342/371 |
| 2018/0083337 | A1* | 3/2018 | Roy | H01Q 1/1228 |
| 2020/0259248 | A1* | 8/2020 | Lv | H01Q 21/0025 |

* cited by examiner

*Primary Examiner* — Robert Karacsony
(74) *Attorney, Agent, or Firm* — Myers Bigel, P.A.

(57) ABSTRACT

A multi-antenna mounting device includes: a mounting member to which two or more antennas are fixable; and a tilt angle adjusting mechanism including an upper adjusting component and a lower adjusting component spaced apart along a length direction of the mounting member. The upper adjusting component includes a plurality of tilt angle adjusting holes arranged in a row, one end of the upper adjusting component is connectable to the mounting member, and the other end is connectable to a user's support pole with a fastening element extending through one of the tilt angle adjusting holes. When the fastening element extends through different tilt angle adjusting holes, the multi-antenna assembly has different mechanical tilt angles relative to the support pole. The lower adjusting component includes a first section and a second section. The second section has a predetermined length and the first section is pivotable relative to the second section.

16 Claims, 6 Drawing Sheets

MULTI-ANTENNA MOUNTING DEVICE AND MULTI-ANTENNA ASSEMBLY

RELATED APPLICATION

The present application claims priority from and the benefit of Chinese Application No. 201922288763.1, filed Dec. 18, 2019, the disclosure of which is hereby incorporated herein by reference in full.

FIELD OF THE INVENTION

The present disclosure generally relates to the field of wireless communications. In particular, the present disclosure relates to a multi-antenna mounting device which enables mechanical tilt angles of two or more antennas to be synchronously adjusted and a multi-antenna assembly.

BACKGROUND OF THE INVENTION

In wireless communication systems, signals are transmitted and received by base station antennas. Attitudes (such as horizontal azimuth and vertical mechanical tilt angle) of the base station antennas are critical to wireless communication networks and may affect the coverage of the base station antennas. Thus, in the process of mounting and employing the base station antennas, it is often necessary to adjust the attitudes of the base station antennas to enable the coverage of the base station antennas up to standard.

With the rapid development of the wireless communication networks (for example, 4G and 5G networks), in some cases, several base station antennas of the same or different types need to be mounted together to accomplish different functions. These base station antennas of the same or different types may also need to cooperate with each other, so it is desirable that their attitudes (especially mechanical tilt angles) can be adjusted synchronously during use. However, in the prior art, these base station antennas are either directly fixed to a user's support pole with their attitudes unable to be adjusted, or these base station antennas' attitudes cannot be adjusted synchronously. Therefore, there is a need for improving the prior art.

SUMMARY OF THE INVENTION

One object of the present disclosure is to provide a multi-antenna mounting device and/or a multi-antenna assembly capable of overcoming at least one drawback in the prior art.

In the first aspect of the present disclosure, a multi-antenna mounting device is provided. The multi-antenna mounting device enables mechanical tilt angles of two or more antennas to be synchronously adjusted and comprises: a mounting member to which the two or more antennas are fixable with one or more fixing mechanisms respectively to form a multi-antenna assembly; and a tilt angle adjusting mechanism including an upper adjusting component and a lower adjusting component spaced apart from each other along a length direction of the mounting member. The upper adjusting component is provided with a plurality of tilt angle adjusting holes arranged in a row, one end of the upper adjusting component is connectable to the mounting member, and the other end of the upper adjusting component is connectable to a user's support pole with a fastening element extending through one of the tilt angle adjusting holes, when the fastening element extends through different tilt angle adjusting holes, the multi-antenna assembly has different mechanical tilt angles relative to the support pole. The lower adjusting component includes a first section being connectable to the mounting member and a second section being connectable to the support pole, the second section has a predetermined length and the first section is pivotable relative to the second section, so that the mechanical tilt angle of the multi-antenna assembly is adjustable between a predetermined negative tilt and a predetermined positive tilt.

According to an embodiment of the present disclosure, the upper adjusting component of the tilt angle adjusting mechanism is configured as a plate-shaped component.

According to an embodiment of the present disclosure, the upper adjusting component of the tilt angle adjusting mechanism is configured as a bearing component for the multi-antenna assembly.

According to an embodiment of the present disclosure, the one end of the upper adjusting component of the tilt angle adjusting mechanism is pivotably connectable to the mounting member.

According to an embodiment of the present disclosure, the one end of the upper adjusting component of the tilt angle adjusting mechanism is provided with an arc-shaped slot, and another fastening element is capable of being located at different positions in the arc-shaped slot under different mechanical tilt angles, so as to accommodate to the inclination of the upper adjusting component caused by the different mechanical tilt angles.

According to an embodiment of the present disclosure, both the first section and the second section of the lower adjusting component of the tilt angle adjusting mechanism have a predetermined length.

According to an embodiment of the present disclosure, the mechanical tilt angle of the multi-antenna assembly is adjustable between −5° and +5°.

According to an embodiment of the present disclosure, the mounting member is configured as an elongated element having a circular, oval, square, polygonal, or irregular shape in cross section.

According to an embodiment of the present disclosure, the fixing mechanism is configured to include a clamping assembly having a front clamp and a rear semi-body, and inner surfaces of the front clamp and the rear clamp are configured to cooperate with each other so that the mounting member is fixable in the clamping assembly.

According to an embodiment of the present disclosure, a plurality of saw teeth are provided on the inner surfaces of the front clamp and the rear semi-body.

According to an embodiment of the present disclosure, the clamping assembly includes at least two front clamp bolt holes passing through the front clamp and at least two rear clamp bolt holes passing through the rear semi-body, and at least two bolts extend through the front clamp bolt holes and the rear clamp bolt holes respectively to fix the mounting member in the clamping assembly.

According to an embodiment of the present disclosure, the fixing mechanism further includes an antenna connecting element, and the antenna is connectable to the mounting member with the antenna connecting element.

According to an embodiment of the present disclosure, the mounting member is configured as an elongated element having a cross-section which is in the shape of "L", "H", "T" or flat plate.

According to an embodiment of the present disclosure, the fixing mechanism is configured as a bolt-and-nut assembly.

According to an embodiment of the present disclosure, the two or more antennas are arranged in a stacked manner along the length direction of the mounting member.

In the second aspect of the present disclosure, a multi-antenna mounting device is provided. The multi-antenna mounting device enables mechanical tilt angles of two or more antennas to be synchronously adjusted comprises: a mounting member to which the two or more antennas are fixable with one or more fixing mechanisms respectively to form a multi-antenna assembly; and a tilt angle adjusting mechanism including an upper adjusting component and a lower adjusting component spaced apart from each other along a length direction of the mounting member. The upper adjusting component includes first and second members, wherein one of the first and second members is provided with a plurality of tilt angle adjusting holes arranged in a row, wherein one end of the first member of upper adjusting component is connectable to the mounting member, and one end of the second member of the upper adjusting component is connectable to a user's support pole, and wherein a fastening element extends through one of the tilt angle adjusting holes, each of the tilt angle adjusting holes corresponding to a different mechanical tilt angle relative to the support pole. The lower adjusting component includes a first section being connectable to the mounting member and a second section being connectable to the support pole, the second section has a predetermined length and the first section is pivotable relative to the second section, so that the mechanical tilt angle of the multi-antenna assembly is adjustable between a predetermined negative tilt and a predetermined positive tilt.

In the third aspect of the present disclosure, a multi-antenna assembly is provided. The multi-antenna assembly comprises: a multi-antenna mounting device according to the present disclosure; and two or more antennas fixed to the multi-antenna mounting device.

It is to be noted that, various aspects of the present disclosure described with respect to one embodiment, although not specifically described with respect to other different embodiments, may be incorporated into the other different embodiments. In other words, all embodiments and/or features in any embodiment may be combined in any manner and/or combination, as long as they do not contradict each other.

BRIEF DESCRIPTION OF THE DRAWINGS

After reading the embodiments below in combination with the drawings, a plurality of aspects of the present disclosure will be better understood. In the drawings.

It is to be understood that like numbers refer to like elements throughout. In the drawings, for the sake of clarity, the sizes of certain features may be modified and may not be drawn to scale.

DESCRIPTION OF THE EMBODIMENTS

Figure 1:
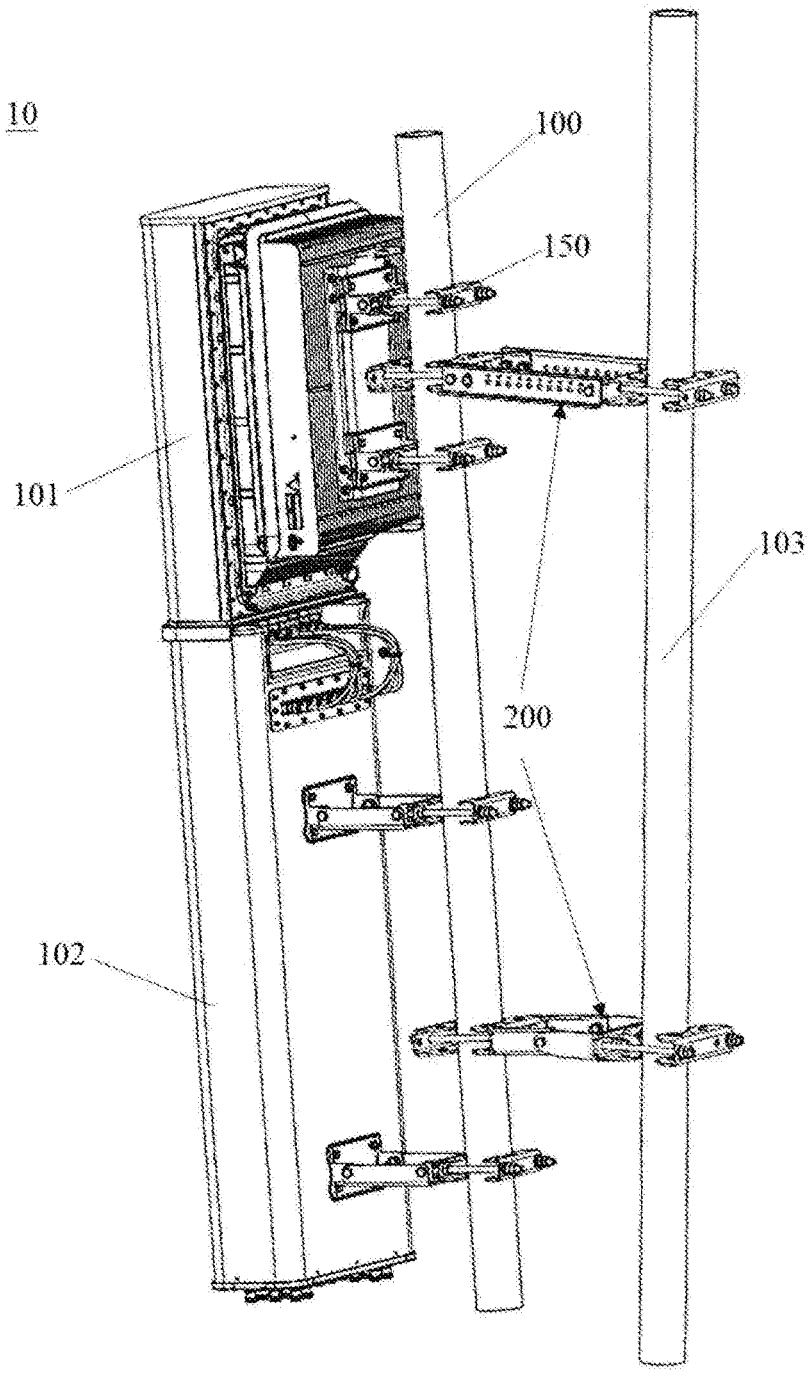
FIG. 1 illustrates a multi-antenna mounting device according to an embodiment of the present disclosure.

The present disclosure will be described below with reference to the drawings, in which several embodiments of the present disclosure are shown. However, it is to be understood that the present disclosure may be embodied in many different forms and should not be construed as limited to the embodiments that are described herein. In fact, the embodiments described hereinafter are intended to make a more complete disclosure of the present disclosure and to adequately explain the scope of the present disclosure to a person skilled in the art. It should also be understood that, the embodiments disclosed herein can be combined in various ways to provide more additional embodiments.

It should be understood that, the wording in the specification is only used for describing particular embodiments and is not intended to limit the present disclosure. All the terms as used herein (including technical and scientific terms) have the meanings as normally understood by a person skilled in the art, unless otherwise defined. For the sake of conciseness and/or clarity, well-known functions or constructions may not be described in detail.

The singular forms "a/an" and "the" as used in the specification, unless clearly indicated, all contain the plural forms. The wordings "comprising", "encompassing" and "containing" used in the specification indicate the presence of the claimed features, but do not repel the presence of one or more other features. The wording "and/or" as used in the specification includes any and all combinations of one or more of the relevant items listed.

As used herein, phrases such as "between X and Y" and "between about X and Y" should be interpreted to include X and Y. As used herein, phrases such as "between about X and Y" mean "between about X and about Y". As used herein, phrases such as "from about X to Y" mean "from about X to about Y."

When an element is referred to as being "on", "attached" to, "connected" to, "coupled" with, "contacting", etc., another element, it can be directly on, attached to, connected to, coupled with or contacting the other element or intervening elements may also be present.

In the specification, words describing spatial relationships such as "up", "down", "above", "below", "top", "bottom" and the like may describe a relation of one feature to another feature in the drawings. It should be understood that these terms also encompass different orientations of the apparatus in use or operation, in addition to encompassing the orientations shown in the drawings. For example, when the apparatus shown in the drawings is turned over, the features previously described as being "below" other features may be described to be "above" other features at this time. The apparatus may also be otherwise oriented (rotated 90 degrees or at other orientations) and the relative spatial relationships will be correspondingly altered.

Referring to FIG. 1, a multi-antenna mounting device 10 according to an embodiment of the present disclosure is shown, by which mechanical tilt angles of two or more antennas can be synchronously adjusted. As shown in FIG. 1, the multi-antenna mounting device 10 may include a mounting member 100 (such as a pole) and a tilt angle adjusting mechanism 200. Two or more antennas 101 and 102 may be fixed to the mounting member 100 with one or more fixing mechanisms 150 respectively to form a multi-antenna assembly 300. The tilt angle adjusting mechanism 200 is disposed between the mounting member 100 and a user's support pole 103 to adjust the tilt angle of the mounting member 100 and thus the tilt angle of the multi-antenna assembly 300 with respect to the support pole 103, thereby achieving synchronous adjustment of mechanical tilt angles of the two or more antennas 101 and 102. In the present disclosure, when the mounting member 100 is substantially parallel to the support pole 103, the mechanical tilt angle is defined as 0°; when a top of the mounting member 100 is tilted away from the support pole 103, the mechanical tilt angle is defined as a "positive tilt angle"; whereas when the top of the mounting member 100 is tilted towards the support pole 103, the mechanical tilt angle is defined as a "negative tilt angle". The tilt angle adjusting mechanism 200 according to the present disclosure may be used to synchronously adjust mechanical tilt angles of the two or more antennas 101 and 102 between a range from a predetermined negative tilt angle to a predetermined positive tilt angle.

Figure 2:
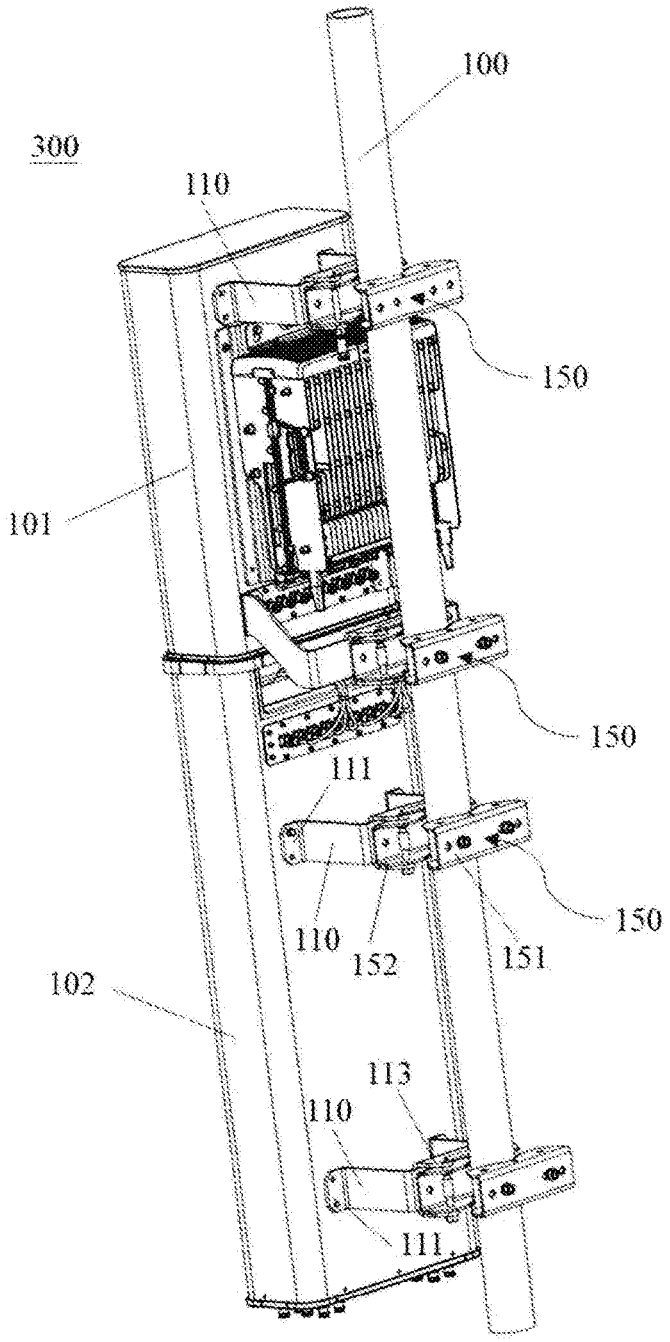
FIG. 2 illustrates a multi-antenna assembly according to an embodiment of the present disclosure.

Referring to FIG. 2, a multi-antenna assembly 300 according to an embodiment of the present disclosure is shown. As shown in FIG. 2, the antennas 101 and 102 are arranged in a stacked manner along a length direction of the mounting member 100. One or more mounting elements 110 are provided on rear panels of the antennas 101 and 102, respectively. The mounting elements 110 may be fastened, by means of appropriate fastening elements such as a bolt-and-nut assembly, to a fixing mechanism 150, which is further fixed to the mounting member 100.

Figure 3:
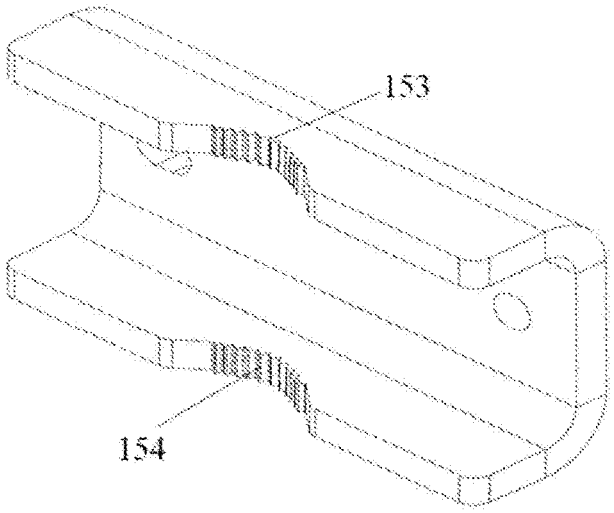
FIG. 3 illustrates the structure of a clamp of a fixing mechanism according to an embodiment of the present disclosure.

The mounting member 100 and the fixing mechanism 150 may have a variety of configurations as required. In the embodiment shown in FIG. 2, the mounting member 100 is configured as an elongated element having a circular cross section. For example, the mounting member 100 may be constituted of an elongated solid cylinder or an elongated hollow cylinder. In other embodiments according to the present disclosure, the mounting member 100 may be configured as an elongated element with a cross-section that is oval, square, polygonal, or irregular. Corresponding to the mounting member 100 in such configurations, the fixing mechanism 150 may be configured to include a clamping assembly having a front clamp 151 and a rear clamp 152. Inner surfaces of the front clamp 151 and the rear clamp 152 may be provided with notches 153. The front clamp 151 and the rear clamp 152 may be connected and fastened by means of releasable fastening elements, so that the mounting member 100 is fixedly clamped in the notches 153 in the inner surfaces of the front clamp 151 and the rear clamp 152. According to an embodiment of the present disclosure, the front clamp 151 may include at least two front clamp bolt holes passing through the front semi-body, and the rear clamp 152 may include at least two rear clamp bolt holes passing through the rear semi-body. At least two bolts may extend through the front clamp bolt holes and the rear clamp bolt holes respectively and be fastened via a plurality of nuts, thereby enabling the mounting member 100 to be fixedly clamped in the notches 153 in the inner surfaces of the front clamp 151 and the rear clamp 152. In order to increase the clamping force applied by the front clamp 151 and the rear clamp 152, the notches 153 in the inner surfaces of the front clamp 151 and the rear clamp 152 may be configured to include non-smooth surfaces to increase the contact and friction forces between each notch 153 and the mounting member 100. In the embodiment shown in FIG. 3, the notches 153 in the inner surfaces of the front clamp 151 and the rear clamp 152 are provided with a plurality of saw teeth 154.

In other embodiments according to the present disclosure, the mounting member 100 may be configured as an elongated element having a cross-section which is in the shape of "L", "H", "T", flat plate, or the like, as illustrated in FIGS. 8A-8D. When the mounting member 100 is in such configurations, the fixing mechanism 150 may be configured merely in the form of a bolt-and-nut assembly. The antennas 101 and 102 may be directly fixed to the mounting member 100 via the mounting element 110 by means of the bolt-and-nut assembly.

Figure 4:
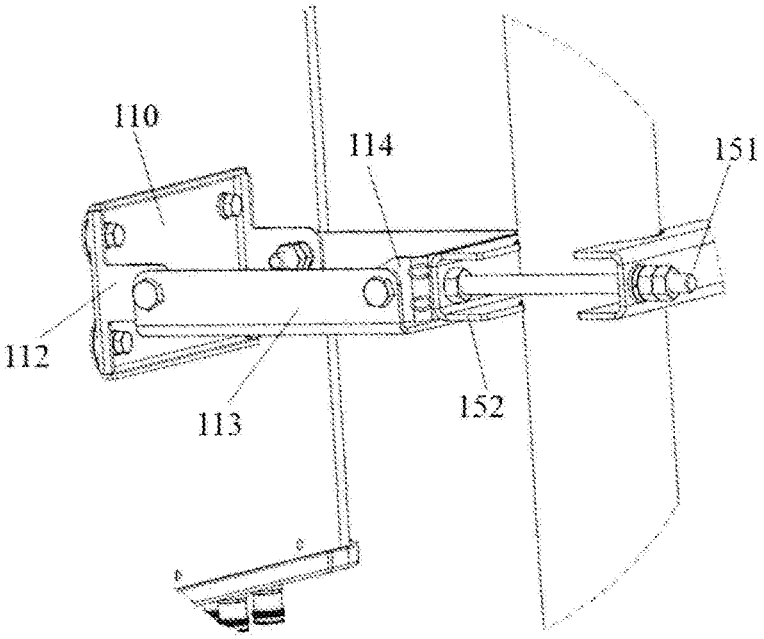
FIG. 4 illustrates a mounting element provided on a rear panel of the antenna and its connection with a mounting member according to an embodiment of the present disclosure.
Figure 5:
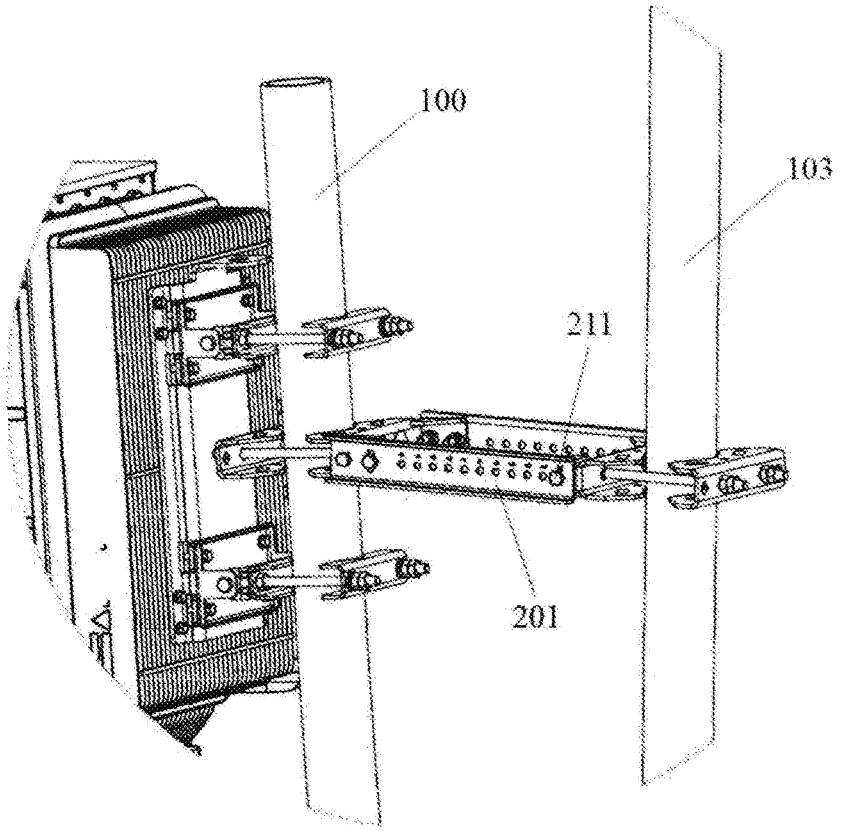
FIG. 5 illustrates an upper adjusting component of a tilt angle adjusting mechanism according to an embodiment of the present disclosure.
Figure 6:
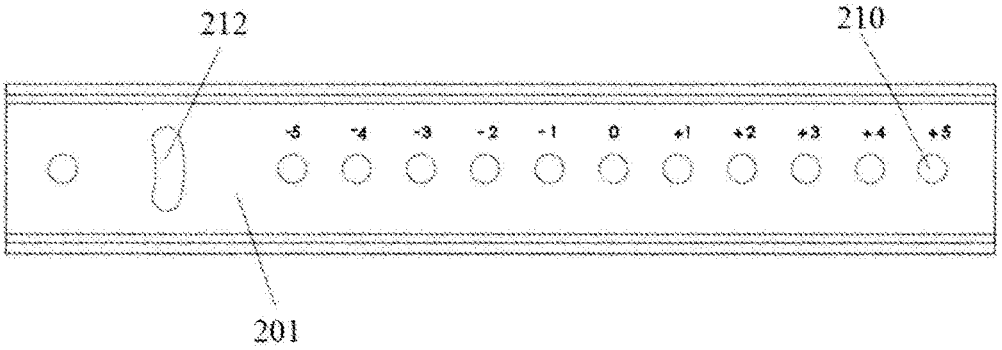
FIG. 6 is a plan view of the upper adjusting component of the tilt angle adjusting mechanism of FIG. 5.

The mounting element 110 may also have a variety of structures. In the embodiment shown in FIG. 2, the mounting element 110 is configured to include a body in the shape of a bridge and legs 111 extending from both ends of the body, and the mounting element 110 is fixed to the rear panels of the antennas 101 and 102 via the legs 111. In the embodiment shown in FIGS. 1 and 4, the mounting element 110 is configured to have a flat plate-shaped body and lugs 112 extending outwards perpendicular to the flat plate-shaped body, and the mounting element 110 is fixed to the rear panels of the antennas 101 and 102 via the flat plate-shaped body. The fixing mechanism 150 may further include an antenna connecting element 113. Based on different structures of the mounting element 110, different antenna connecting elements may be used to connect the mounting element 110 and the fixing mechanism 150. In the embodiment shown in FIG. 2, the antenna connecting element 113 may be used to connect the mounting element 110 and the fixing mechanism 150 by clamping the body of the mounting element 110 between the antenna connecting element 113 and the rear clamp 152 of the fixing mechanism 150. In the embodiments shown in FIG. 1 and FIG. 4, lugs 114 extending rearwards may be formed on the rear clamp 152 of the fixing mechanism 150, and the antenna connecting element 113 may be used to connect the mounting element 110 and the fixing mechanism 150 by connecting the lug 112 of the mounting element 110 with the lug 114 on the clamp body 152. However, the present disclosure is not limited thereto, and antenna connecting elements in any other suitable form may also be used.

The tilt angle adjusting mechanism 200 according to an embodiment of the present disclosure will be described with reference to FIG. 1 and FIGS. 5-7. The tilt angle adjusting mechanism 200 may include an upper adjusting component 201 and a lower adjusting component 202 spaced apart from each other along a length direction of the mounting member 100. As shown more clearly in FIG. 6, the upper adjusting component 201 may be substantially plate-shaped and provided with a plurality of tilt angle adjusting holes 210 in a row. In use, one end of the upper adjusting component 201 may be connected to the mounting member 100, and the other end of the upper adjusting component 201 may be connected to the user's support pole 103 with a fastening element 211 extending through one of the tilt angle adjusting holes 210. When the fastening element 211 extends through different tilt angle adjusting holes 210, the mounting member 100 is tilted at different angles with respect to the support pole 103, thereby allowing the multi-antenna assembly 300 and thus the two or more antennas 101 and 102 to have different mechanical tilt angles relative to the support pole 103. The distance between adjacent tilt angle adjusting holes 210 and the distance between the upper adjusting component 201 and the lower adjusting component 202 may be selected so that each tilt angle adjusting hole 210 corresponds to a predetermined mechanical tilt angle. According to an embodiment of the present disclosure, the difference of the mechanical tile angles between adjacent tilt angle adjusting holes 210 may be one degree. However, the present disclosure is not limited thereto, and the distance between adjacent tilt angle adjusting holes 210 may be selected such that the difference of the mechanical tile angles between adjacent tilt angle adjusting holes 210 may be 0.5°, 1.5°, 2°, and the like. According to an embodiment of the present disclosure, the upper adjusting component 201 may also serve as a bearing component for the multi-antenna assembly 300. The upper adjusting component 201 may have a sufficient structural strength to withstand the desired load (such as wind load, or the like). By endowing the upper adjusting component 201 with both adjusting and bearing functions, the structures of the tilt angle adjusting mechanism and other possible bearing components can be greatly simplified, costs are reduced, and the mounting and adjusting processes become easier.

Figure 7:
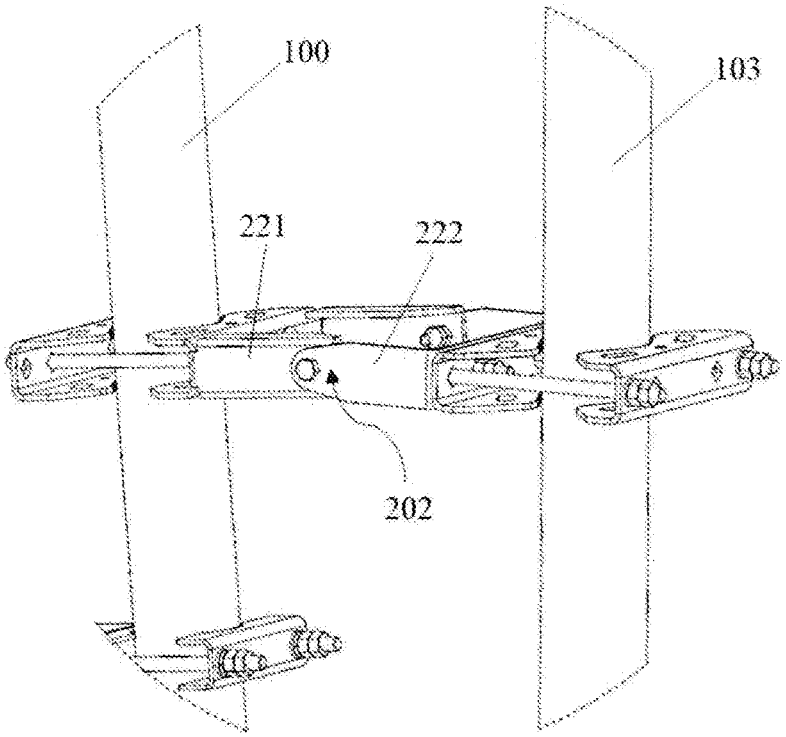
FIG. 7 illustrates a lower adjusting component of the tilt angle adjusting mechanism according to an embodiment of the present disclosure.
Figure 8A:
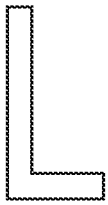
FIG. 8A illustrates a cross-sectional configuration of a mounting member having an "L" shape, according to some embodiments of the present invention.
Figure 8B:
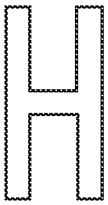
FIG. 8B illustrates a cross-sectional configuration of a mounting member having an "H" shape, according to some embodiments of the present invention.
Figure 8C:
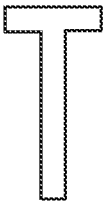
FIG. 8C illustrates a cross-sectional configuration of a mounting member having a "T" shape, according to some embodiments of the present invention.
Figure 8D:
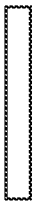
FIG. 8D illustrates a cross-sectional configuration of a mounting member having the shape of a flat plate, according to some embodiments of the present invention.

Referring to FIG. 7, the lower adjusting component 202 may be configured to include a first section 221 and a second section 222. The first section 221 may be connected to the mounting member 100, and the second section 222 may be connected to the user's support pole 103. The first section 221 is configured to be pivotable relative to the second section 222. According to an embodiment of the present disclosure, the length of the second section 222 may be selected based on the distance between the upper adjusting component 201 and the lower adjusting component 202, so that the mechanical tilt angle of the multi-antenna assembly 300 may be adjusted between a range from a predetermined negative tilt angle and a predetermined positive tilt angle. According to another embodiment of the present disclosure, the lengths of both the first section 221 and the second section 222 may be selected based on the distance between the upper adjusting component 201 and the lower adjusting component 202, so that the mechanical tilt angle of the multi-antenna assembly 300 may be adjusted between a range from a predetermined negative tilt angle to a predetermined positive tilt angle.

According to an embodiment of the present disclosure, the tilt angle adjusting mechanism 200 is configured such that the mechanical tilt angle of the multi-antenna assembly 300 and thus of the two or more antennas 101 and 102 can be adjusted between −5° and +5°. However, the present disclosure is not limited thereto, and the tilt angle adjusting mechanism 200 may also be configured such that the mechanical tilt angle of the multi-antenna assembly 300 and thus of the two or more antennas 101 and 102 can be adjusted in other ranges, such as in −3°~+3°, −4°~+4°, −6°~+6°, −8°~+8°, −5°~+8°, −3°~+8°, −8°~+3°, −8°~+5°, etc.

When adjusting the mechanical tilt angle, a technician may only release the end of the upper adjusting component 201 that is in connection with the support pole 103, and then move the upper adjusting component 201 away or towards the support pole 103 to select the desired mechanical tilt angle. When the upper adjusting component 201 is moved to a desired position, the fastening element 211 is allowed to extend through corresponding tilt angle adjusting holes 210 and to connect the upper adjusting component 201 with the user's support pole 103. In order to facilitate adjustment, according to an embodiment of the present disclosure, the end of the upper adjusting component 201 that is in connection with the mounting member 100 may be configured to be pivotably connected to the mounting member 100. According to another embodiment of the present disclosure, the end of the upper adjusting component 201 that is in connection with the mounting member 100 may be provided with an arc-shaped slot 212, and the corresponding fastening element may be located at different positions in the arc-shaped slot 212 under different mechanical tilt angles, so as to accommodate to the possible inclination of the upper adjusting component 201 that may be caused by the different mechanical tilt angles. The upper adjusting component 201 and the lower adjusting component 202 of the tilt angle adjusting mechanism 200 may be connected to the mounting member 100 and the user's support pole 103 by means of fixing mechanisms (such as the fixing mechanism 150). These fixing mechanisms may be formed as parts of the upper adjusting component 201 or the lower adjusting component 202 of the tilt angle adjusting mechanism 200. For example, the upper adjusting component 201 may include a plate provided with the tilt angle adjusting holes 210 and a fixing mechanism connected to the plate.

With two or more antennas being fixed to a mounting member to form a multi-antenna assembly and the mechanical tilt angle of the multi-antenna assembly being adjusted by a tilt angle adjusting mechanism according to the present disclosure, the multi-antenna mounting device according to the present disclosure achieves the synchronous adjustment of the mechanical tilt angles of two or more antennas. With the upper adjusting component also serving as a bearing component to make it have both adjusting and bearing functions, the tilt angle adjusting mechanism according to the present disclosure has a greatly simplified structure, and thus saves the costs, and makes the mounting and adjusting processes become easier. In addition, with the lower adjusting component being configured to include a first section and a second section pivotable relative to each other and with the length of at least the second section being selectable, the tilt angle adjusting mechanism according to the present disclosure achieves adjustment of the mechanical tilt angle between a range from a predetermined negative tilt angle to a predetermined positive tilt angle.

Exemplary embodiments in accordance with the present disclosure have been described above with reference to the accompanying drawings. However, it shall be understood by those skilled in the art that various changes and modifications of the exemplary embodiments of the present disclosure can be made without departing from the spirit and scope of the present disclosure. All such variations and modifications are intended to be included within the scope of this disclosure as defined in the claims. The present disclosure is defined by the accompanying claims, and equivalents of these claims are also included.

What is claimed is:

1. A multi-antenna mounting device which enables mechanical tilt angles of two or more antennas to be synchronously adjusted comprising:

a mounting member to which the two or more antennas are fixable with one or more fixing mechanisms respectively to form a multi-antenna assembly; and a tilt angle adjusting mechanism including an upper adjusting component and a lower adjusting component spaced apart from each other along a length direction of the mounting member;

wherein the upper adjusting component is provided with a plurality of tilt angle adjusting holes arranged in a row, one end of the upper adjusting component is pivotably connectable to the mounting member, and the other end of the upper adjusting component is connectable to a user's support pole with a fastening element extending through one of the tilt angle adjusting holes, when the fastening element extends through different tilt angle adjusting holes, the multi-antenna assembly has different mechanical tilt angles relative to the support pole; and wherein the lower adjusting component includes a first section being connectable to the mounting member and a second section being connectable to the support pole, the second section has a predetermined length and the first section is pivotable relative to the second section, so that the mechanical tilt angle of the multi-antenna assembly is adjustable between a predetermined negative tilt and a predetermined positive tilt.

2. The multi-antenna mounting device according to claim 1, characterized in that the upper adjusting component of the tilt angle adjusting mechanism is configured as a plate-shaped component.

3. The multi-antenna mounting device according to claim 1, characterized in that the upper adjusting component of the tilt angle adjusting mechanism is configured as a bearing component for the multi-antenna assembly.

4. The multi-antenna mounting device according to claim 1, characterized in that both the first section and the second section of the lower adjusting component of the tilt angle adjusting mechanism have a predetermined length.

5. The multi-antenna mounting device according to claim 1, characterized in that the mechanical tilt angle of the multi-antenna assembly is adjustable between −5° and +5°.

6. The multi-antenna mounting device according to claim 1, characterized in that the mounting member is configured as an elongated element having a circular, oval, square, polygonal, or irregular shape in cross section.

7. The multi-antenna mounting device according to claim 6, characterized in that the fixing mechanism is configured to include a clamping assembly having a front clamp and a rear clamp, and inner surfaces of the front clamp and the rear clamp are configured to cooperate with each other so that the mounting member is fixable in the clamping assembly.

8. The multi-antenna mounting device according to claim 7, characterized in that a plurality of saw teeth are provided on the inner surfaces of the front clamp and the rear clamp.

9. The multi-antenna mounting device according to claim 7, characterized in that the clamping assembly includes at least two front clamp bolt holes passing through the front clamp and at least two rear clamp bolt holes passing through the rear clamp, and at least two bolts extend through the front clamp bolt holes and the rear clamp bolt holes respectively to fix the mounting member in the clamping assembly.

10. The multi-antenna mounting device according to claim 7, characterized in that the fixing mechanism further includes an antenna connecting element, and the antenna is connectable to the mounting member with the antenna connecting element.

11. The multi-antenna mounting device according to claim 1, characterized in that the mounting member is configured as an elongated element having a cross-section which is in the shape of "L", "H", "T" or flat plate.

12. The multi-antenna mounting device according to claim 11, characterized in that the fixing mechanism is configured as a bolt-and-nut assembly.

13. The multi-antenna mounting device according to claim 1, characterized in that the two or more antennas are arranged in a stacked manner along the length direction of the mounting member.

14. A multi-antenna mounting device which enables mechanical tilt angles of two or more antennas to be synchronously adjusted comprising:

a mounting member to which the two or more antennas are fixable with one or more fixing mechanisms respectively to form a multi-antenna assembly; and a tilt angle adjusting mechanism including an upper adjusting component and a lower adjusting component spaced apart from each other along a length direction of the mounting member;

wherein the upper adjusting component includes first and second members, wherein one of the first and second members is provided with a plurality of tilt angle adjusting holes arranged in a row, wherein one end of the upper adjusting component is pivotably connectable to the mounting member, and an opposite end of the upper adjusting component is connectable to a user's support pole, and wherein a fastening element extends through one of the tilt angle adjusting holes, each of the tilt angle adjusting holes corresponding to a different mechanical tilt angle relative to the support pole; and wherein the lower adjusting component includes a first section being connectable to the mounting member and a second section being connectable to the support pole, the second section has a predetermined length and the first section is pivotable relative to the second section, so that the mechanical tilt angle of the multi-antenna assembly is adjustable between a predetermined negative tilt and a predetermined positive tilt.

15. A multi-antenna assembly comprising:

a multi-antenna mounting device according to claim 1; and two or more antennas fixed to the multi-antenna mounting device.

16. A multi-antenna mounting device which enables mechanical tilt angles of two or more antennas to be synchronously adjusted comprising:

a mounting member to which the two or more antennas are fixable with one or more fixing mechanisms respectively to form a multi-antenna assembly; and a tilt angle adjusting mechanism including an upper adjusting component and a lower adjusting component spaced apart from each other along a length direction of the mounting member;

wherein the upper adjusting component comprises a plurality of tilt angle adjusting holes arranged in a row, one end of the upper adjusting component is connectable to the mounting member, and the other end of the upper adjusting component is connectable to a user's support pole with a fastening element extending through one of the tilt angle adjusting holes, when the fastening element extends through different tilt angle adjusting holes, the multi-antenna assembly has different mechanical tilt angles relative to the support pole;

wherein the one end of the upper adjusting component of the tilt angle adjusting mechanism comprises an arc-shaped slot, and another fastening element is capable of being located at different positions in the arc-shaped slot under the different mechanical tilt angles, so as to accommodate to the inclination of the upper adjusting component caused by the different mechanical tilt angles; and wherein the lower adjusting component comprises a first section being connectable to the mounting member and a second section being connectable to the support pole, the second section has a predetermined length and the first section is pivotable relative to the second section, so that the mechanical tilt angle of the multi-antenna assembly is adjustable between a predetermined negative tilt and a predetermined positive tilt.

* * * * *